US007753576B2

(12) United States Patent
Marcinkewicz et al.

(10) Patent No.: US 7,753,576 B2
(45) Date of Patent: Jul. 13, 2010

(54) LIGHT EMITTING FLOTATION DEVICE

(76) Inventors: Dorothy J. Marcinkewicz, 409 Quail Run Rd., Versailles, KY (US) 40383; Kevin O'Donnell, 1091 S. Talcott, Waukegan, KY (US) 60085

( * ) Notice: Subject to any disclaimer, the term of this patent is extended or adjusted under 35 U.S.C. 154(b) by 14 days.

(21) Appl. No.: 12/082,429

(22) Filed: Apr. 11, 2008

(65) Prior Publication Data

US 2008/0266860 A1 Oct. 30, 2008

Related U.S. Application Data

(60) Provisional application No. 60/922,784, filed on Apr. 11, 2007.

(51) Int. Cl.
*F21V 7/04* (2006.01)

(52) U.S. Cl. ..... 362/555; 362/183; 362/101; 362/565

(58) Field of Classification Search ..... 362/101, 362/183, 555, 565
See application file for complete search history.

(56) References Cited

U.S. PATENT DOCUMENTS 3,621,501 A * 11/1971 Jordan ..... 441/89
4,976,642 A 12/1990 Wilkie
5,030,152 A 7/1991 Carr et al.
5,370,566 A 12/1994 Mitchell, Jr. et al.
5,603,648 A * 2/1997 Kea ..... 441/106
7,004,807 B1 2/2006 Summers
2006/0092630 A1 * 5/2006 Kennedy et al. ..... 362/157

* cited by examiner

*Primary Examiner*—Jong-Suk (James) Lee
*Assistant Examiner*—Julie A Shallenberger
(74) *Attorney, Agent, or Firm*—James Ray & Assoc

(57) ABSTRACT

A flotation device includes a pocket formed within its hollow body in open communication with an exterior surface thereof and a hollow housing mounted in the pocket. Illuminatable fiber optic strands are disposed in a predetermined pattern within the hollow body each having a light receiving end thereof protruding into the pocket through a wall thereof in an air impermeable manner and further into the housing. An illumination source is mounted inside the housing in close proximity to the light receiving ends of the fiber optic strands and a power source is also disposed within the housing and operatively coupled to the illumination source. A multi-colored filter pane is mounted within the housing intermediate the illumination source and the receiving end of the each illuminatable fiber optic strand. A switch is provided and is manually operable by a user to operate the illumination source causing the strands to emit light.

14 Claims, 3 Drawing Sheets

LIGHT EMITTING FLOTATION DEVICE

CROSS-REFERENCE TO RELATED APPLICATIONS

This application is related to and claims priority from U.S. Provisional Patent Application Ser. No. 60/922,784 filed on Apr. 11, 2007.

FIELD OF THE INVENTION

The present invention relates, in general, to flotation devices and, more particularly, this invention relates to an inflatable flotation device having a hollow body and a light emitting assembly mounted therewithin.

BACKGROUND OF THE INVENTION

As is generally well known, whether relaxing at a natural beach, artificial lake, water park or home swimming pool, water-loving consumers delight in new and unique accessories that will increase their fun and enjoyment. Children and adults alike who enjoy swimming in a public or private body of water often enjoy the use of an inflatable flotation device. Many also use inflatable hollow body watercrafts for fishing or other recreational activities. Prior to the conception and design of the present invention, swimming or use of the inflatable flotation device during darkness or nightfall conditions is disadvantaged by low light and reduced visibility. Thus, during these conditions, individuals rely on artificial lighting to enhance their safety. However, this artificial lighting is either inadequate to sufficiently illuminate entire area or interferes with the nightfall ambiance. It is also common for some to attach lights to a watercraft not only for safety but also for decorative purposes.

Therefore, there is a need for an inflatable flotation device having a hollow body and capable of emitting light through a wall thereof.

SUMMARY OF THE INVENTION

The invention provides a flotation device. The flotation device includes a water impermeable hollow body. The body has a predetermined shape and is formed from a light permeable material. A light emitting assembly is mounted within the hollow body and is operable to emanate light through the light permeable material.

The invention also provides a light emitting assembly for a flotation device having a water impermeable hollow body. The light emitting assembly includes a pocket which is formed within the hollow body in open communication with an exterior surface thereof and in an air impermeable manner with an interior portion of the hollow body. A hollow housing is mounted in the pocket. A plurality of illuminatable fiber optic strands are disposed in a predetermined pattern within the hollow body. Each fiber optic strand has a light receiving end and a light emitting end. The light receiving end protrudes into the pocket through a wall thereof in an air impermeable manner. The light receiving end further protrudes through one end of the housing and is secured therewithin. An illumination source is mounted inside the housing in close proximity to the light receiving ends of the fiber optic strands. A power source is disposed inside the housing and operatively coupled to the illumination source. A filter pane is mounted within the housing intermediate the illumination source and the receiving end of each illuminatable fiber optic strand. The filter pane has a plurality of portions each formed from a light permeable material having a distinct color. Accordingly, the fiber optic strands having light receiving ends thereof aligned with a respective portion of the filter pane emit a light having a color which is generally identical to the distinct color of such portion. A switch is also provided and is manually operable by a user to selectively operate the illumination source.

The present invention additionally provides a method of illumination. The method includes the step of providing a flotation device having a water impermeable hollow body. Then, forming the hollow body from a light permeable material. Next, mounting a light emitting assembly within the hollow body. Operating the light emitting assembly to emit light. Finally, emanating the emitted light through the light permeable material.

OBJECTS OF THE INVENTION

It is, therefore, one of the primary objects of the present invention to provide a light emitting inflatable flotation device.

Another object of the present invention is to provide a light emitting inflatable flotation device having a hollow body and a light emitting assembly mounted therewithin.

Yet another object of the present invention is to provide a light emitting inflatable flotation device capable of emanating the light through the light permeable body material.

A further object of the present invention is to provide a light emitting inflatable flotation device that employs illuminatable fiber optic strands.

Yet a further object of the present invention is to provide a light emitting inflatable flotation device that is capable of emanating light of different colors.

An additional object of the present invention is to provide a light emitting inflatable flotation device that includes a solar panel for charging rechargeable batteries employed for powering a light emitting assembly.

Another object of the present invention is to provide a method of illumination employing the above-described light emitting inflatable flotation device.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
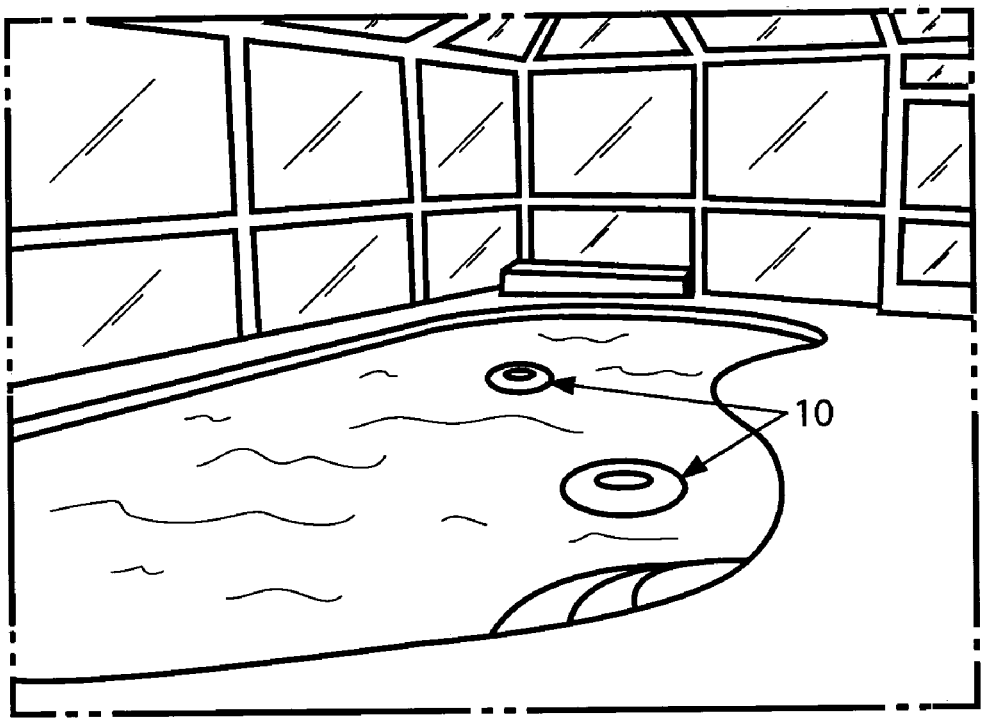
FIG. 1 is an environmental view of a light emitting flotation device of the present invention.
Figure 2:
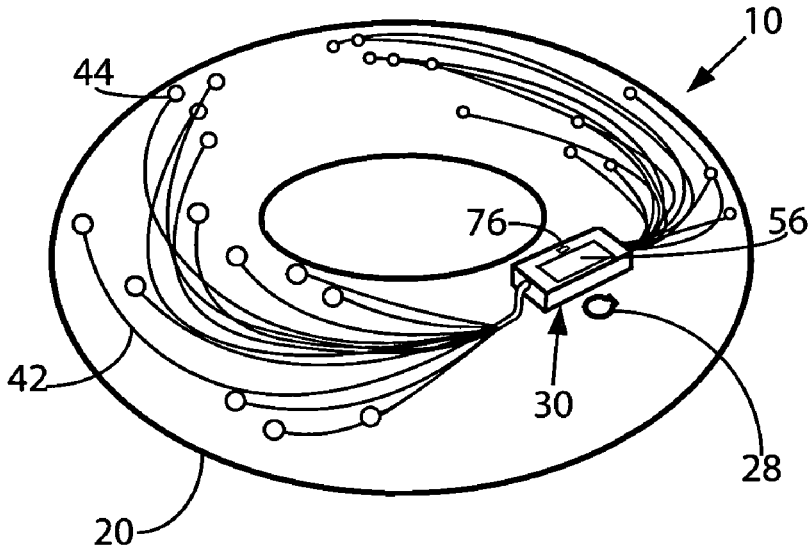
FIG. 2 is an isometric view of the light emitting flotation device which is constructed in accordance with a presently preferred embodiment of the invention.
Figure 3:
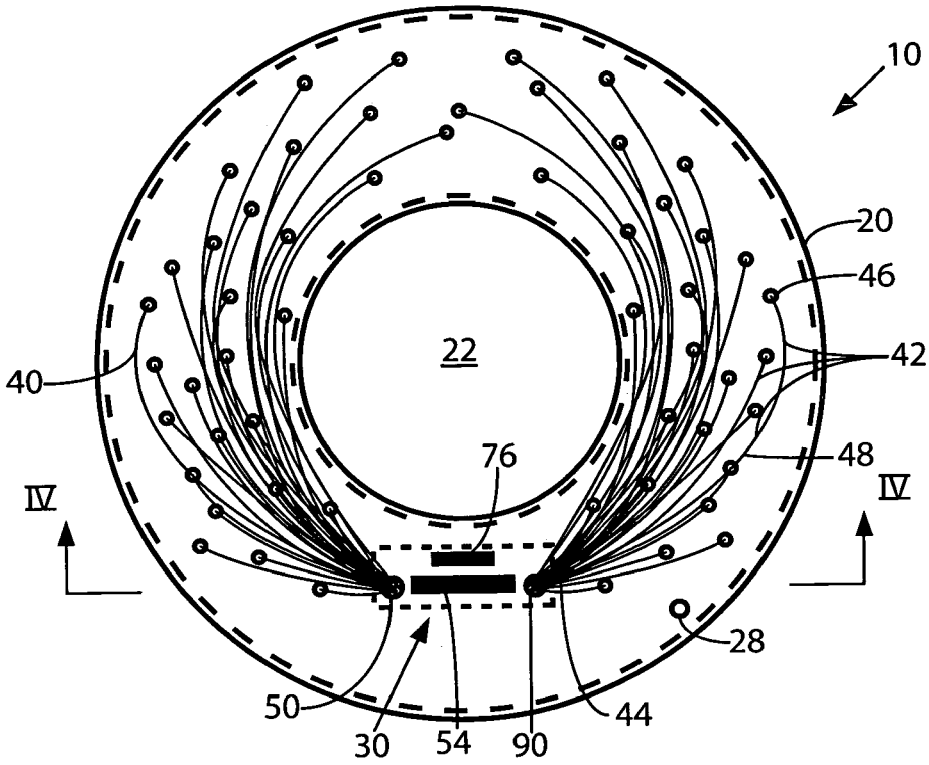
FIG. 3 is a schematic view of the light emitting flotation device of FIG. 2.
Figure 4:
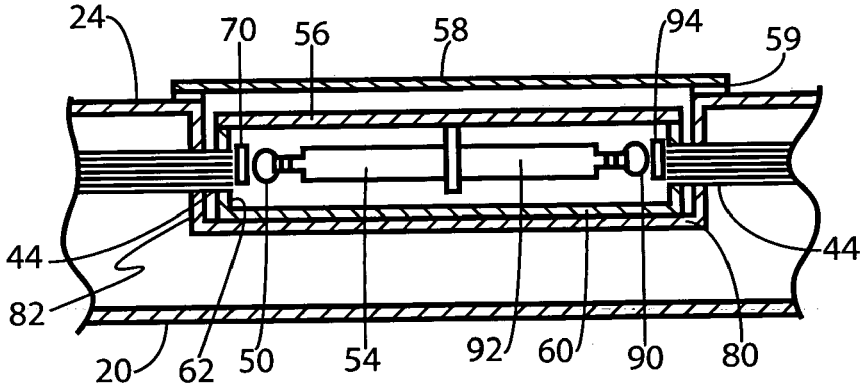
FIG. 4 is a semi-schematic cross-sectional view along lines IV-IV of FIG. 3.
Figure 5:
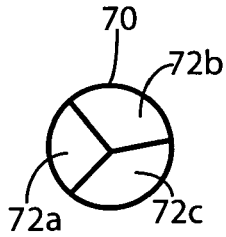
FIG. 5 is a planar view of a filter pane employed in the light emitting flotation device of FIG. 2.

Prior to proceeding to the more detailed description of the present invention, it should be noted that, for the sake of clarity and understanding, identical components which have identical functions have been identified with identical reference numerals throughout the several views illustrated in the drawing figures.

It is to be understood that the definition of an inflatable flotation device includes but is not limited to ring, raft, watercraft, toy and the like devices.

The best mode for carrying out the invention is presented in terms of its presently preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

Reference is now made, to FIGS. 1-6, wherein there is shown a flotation device, generally designated as 10. The present invention is illustrated and described in combination with a conventional inflatable ring, although it will be apparent to those skilled in the relevant art that the present invention may be applied to other inflatable flotation devices and as such should not be interpreted as a limiting factor of the flotation device 10 of the present invention. The flotation device 10 includes a water impermeable hollow body 20 having a predetermined shape and formed from a light permeable material. The hollow body 20 has a circular circumference and a central circular aperture 22 formed therethrough. The body 20 also has a generally circular vertical cross-section throughout. As is conventionally known, the hollow body 20 may be equipped with a valve 28 operatively mounted within a wall portion thereof for enabling selective inflation and deflation of such hollow body 20.

A light emitting assembly, generally designated as 30, is also provide and is mounted within the hollow body 20. The light emitting assembly 30 is operable to emanate light through the light permeable material of the hollow body 20. The light emitting assembly 30 includes at least one light emitting member 40 and means operatively coupled thereto to cause the light emitting member 40 to emit the light.

In accordance with a presently preferred embodiment of the invention, the light emitting member 40 is of illuminatable fiber optic type and includes a plurality of illuminatable fiber optic strands 42 disposed in a predetermined pattern within the hollow body 20. The present invention contemplates that the illuminatable fiber optic strands 42 are of a conventional type including a fiber element encased in a cladding and an optional jacket and are characterized by a light receiving end 44 and a light emitting end 46. An illumination source 50 is also disposed within the hollow body 20 and is positioned in close proximity to the light receiving ends 44 of the illuminatable fiber optic strands 42. The illumination source 50 may be of any well known types presently employed in fiber optic lighting and generally being of either incandescent lamp, light emitting diode (LED) or gas discharged lamp.

A power source is operatively connected to the illumination source 50 to provide power thereto causing the illumination source 50 to emit light. The power source is preferably at least one battery 54. The battery 54 may be of a rechargeable or a non-rechargeable type. Since the flotation device 10 is generally exposed to light, it is also within the scope of the present invention to provide a conventional solar cell 56 capable of collecting solar energy and converting such solar energy into electric energy. By way of an example only, such solar cell 56 is disclosed in U.S. Pat. No. 6,294,724 to Sasaoka et al. and advantageously provided with a transparent waterproof film which is coated and dried on the surface of the solar cell, thereby preventing entry of water from the front surface of the solar cell element.

Preferably, the exterior surface of the solar cell 56 is mounted flush with an exterior surface 24 of the hollow body 20. It is further presently preferred to removably attach the solar cell 56, for example with use of hook and loop fasteners (not shown). If required, a clear cover 58 may be positioned over the solar cell 56 and attached to the exterior surface 24 of the hollow body 20 in a water impermeable manner, for example by way of a waterproof two-sided adhesive tape 59. It will be understood that the solar cell 56 may be advantageous for use as a recharging device in combination with a battery 54 of a rechargeable type.

In operation, the light emitted by the illumination source 50 is received at the light receiving ends 44 of the illuminatable fiber optic strands 42 and emitted through at least one of the light emitting end 46 and a peripheral surface 48 of the illuminatable fiber optic strands 42. The use of the light permeable material of the hollow body 20 enables the emitted light to emanate through such material. The material of the hollow body 20 may be either transparent or semi-transparent depending on the particular application and/or user preference.

In order to protect the illuminatable fiber optic strands 42 from harmful ultraviolet (UV) radiation, a conventional UV protective coating 29 may be applied onto the exterior surface 26 of the hollow body 20 or any of the well known UV inhibitors may be incorporated into the material of the hollow body 20 during the polymerization process thereof.

Equally as well, the intensity of the emanated light will depend on the type and quantity of the illuminatable fiber optic strands 42 and output of the illumination source 50. It would be appreciated that the light emitting flotation devices 10 intended for use as safety device may emanate a greater amount of light than the light emitting flotation devices 10 intended to be used in decorative lighting applications.

The illumination source 50 and the power source may be directly secured to an interior wall surface of the body 20, however, in order to facilitate installation of the light emitting assembly 30, it is presently preferred to provide a housing 60 and to mount the power source 54 and the illumination source 50 within the housing 60. Accordingly, as it is well known, the light receiving ends 46 of the strands 42 will be passed through and secured within the end 62 of the housing 60 and the illumination source 50 will be positioned in close proximity to such light receiving ends 46.

When it is required to emanate light of different colors, the light emitting flotation device 10 may include an optional multi-colored filter pane 70 mounted intermediate the illumination source 50 and the light receiving end 44 of each fiber optic strand 42. As is conventional, the multi-colored filter pane 70 has a plurality of portions each formed from a light permeable material having a distinct color and wherein fiber optic strands 42 aligned with each portion of the filter pane 70 emit a light having a color which is generally identical to the distinct color of the each portion. By way of an example only of FIG. 5, the filter pane 70 is illustrated as having three portions 72*a*, 72*b* and 72*c* each characterized by a distinct color, although other configurations are also contemplated by the present invention.

It is also within the scope of the present invention to provide a switch 76 manually operable by a user to selectively operate the illumination source 50.

In order to facilitate access to the illumination source 50 or the power source, it is presently preferred to provide a pocket 80 integrally formed within the hollow body 20 in an air impermeable manner so as to retain the hollow body 20 in an inflated condition and mount at least the illumination source 50 and the power sources 54, 56 within such pocket 80. Accordingly, the light receiving ends 44 will protrude into the pocket 80 through a wall 82 thereof in an air impermeable manner.

The quantity and pattern of the fiber optic strands 42 will depend on the shape of the hollow body 20. By way of an example only of FIGS. 2-3, when the hollow body 20 has a ring shape, the fiber optic strands 42 are provided in different lengths. Bendable feature of the fiber optic strands 42 is advantageous to accommodate circular shape of the hollow body 20.

It is also within the scope of the present invention to provide a second plurality of illuminatable fiber optic strands 42 and position them opposite of the first plurality of the fiber optic strands 42. Accordingly, a second illumination source 90, second battery 92 and a second filter pane 94 are also provided and being constructed and mounted generally identical to the illumination source 50, battery 54 and filter pane 70 respectively.

Figure 6:
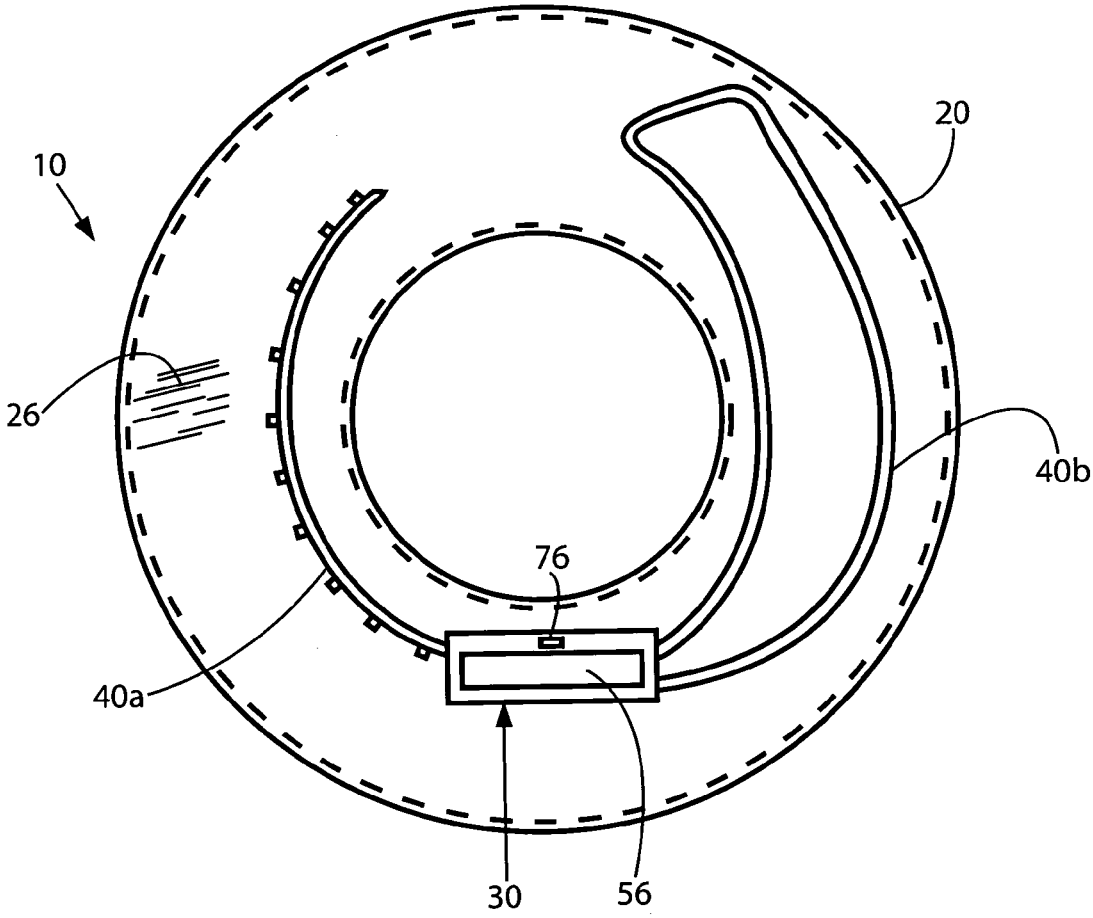
FIG. 6 is a schematic view of the light emitting flotation device which is constructed in accordance with an alternative embodiment of the invention.

Now in a particular reference to FIG. 6, therein is illustrated the light emitting member 40 of alternative constructions, such as flexible light emitting diode strip 40*a* or flexible gas-discharge tube type 40*b*. By way of an example only, the flexible light emitting diode strip 40*a* may be of a type as manufactured and/or distributed by Del Lighting, Inc of San Antonio Tex.

The method of illumination, in accordance with the above-described embodiments, includes the step of providing a flotation device having a water impermeable hollow body. Forming the hollow body from a light permeable material. Then, mounting a light emitting device within the hollow body. Next, operating the light emitting device to emit light. Finally emanating the emitted light through the light permeable material of the body. The method also includes the step of positioning the light emitting device directly onto the surface of the body of water 2 as best shown in FIG. 1 or in close proximity to such body of water 2.

Although the present invention has been shown in terms of the flotation device 10 shaped as a well known ring, it will be apparent to those skilled in the art, that the present invention may be applied to other inflatable flotation devices. For example, at least one the light emitting assembly 30 may be mounted within an inflatable watercraft commonly employed for fishing or other recreational activities.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. In combination with a flotation device having a water impermeable hollow body, a light emitting assembly comprising:

(a) a pocket formed within said hollow body in open communication with an exterior surface thereof and in an air impermeable manner with an interior portion of said hollow body;

(b) a hollow housing mounted in said pocket;

(c) a plurality of illuminatable fiber optic strands disposed in a predetermined pattern within said hollow body each having a light receiving end and a light emitting end, wherein said light receiving ends protrude into said pocket through a wall thereof in an air impermeable manner, said light receiving ends further protrude through one end of said housing and are secured therewithin;

(d) an illumination source mounted within said housing in close proximity to said light receiving ends of said fiber optic strands;

(e) a power source disposed within said housing and operatively coupled to said illumination source;

(f) a filter pane mounted within said housing intermediate said illumination source and said receiving end of said each illuminatable fiber optic strand, said filter pane having a plurality of portions each formed from a light permeable material having a distinct color and wherein fiber optic strands having light receiving ends thereof aligned with said each portion of said filter pane emit a light having a color which is generally identical to said distinct color of said each portion; and (g) a switch manually operable by a user to selectively operate said illumination source.

2. The light emitting assembly, according to claim 1, wherein said light emitting assembly further includes:

(a) a second illuminatable fiber optic strands disposed in a second predetermined pattern within said hollow body each having a second light receiving end and a second light emitting end, wherein said second light receiving ends protrude into said pocket through a second wall thereof in an air impermeable manner, said light receiving ends further protrude through an opposed end of said housing and are secured therewithin;

(b) a second illumination source mounted inside said housing in close proximity to said second light receiving ends of said second plurality of fiber optic strands; and (c) a second filter pane mounted within said housing intermediate said second illumination source and said second receiving end of said each second illuminatable fiber optic strand, said second filter pane having a plurality of portions each formed from a light permeable material having a distinct color and wherein said second illuminatable fiber optic strands having light receiving ends thereof aligned with said each portion of said second filter pane emit a light having a color which is generally identical to said distinct color of said each portion of said second filter pane.

3. A flotation device comprising in combination:

(a) a water impermeable hollow body having a predetermined shape and formed from a light permeable material; and (b) a light emitting assembly mounted within said hollow body and operable to emanate light through said light permeable material, said light emitting assembly including:

(i) a plurality of illuminatable fiber optic strands disposed in a predetermined pattern within said hollow body each having a light receiving end and a light emitting end, (ii) an illumination source disposed within said hollow body and positioned in close proximity to light receiving ends of said illuminatable fiber optic strands, and (iii) a power source operatively connected to said illumination source to provide power thereto causing said illumination source to emit light, whereby said emitted light is received at said light receiving ends of said illuminatable fiber optic strands and emitted through at least one of said light emitting end and a peripheral surface thereof; and (c) a filter pane mounted intermediate said illumination source and said receiving end of said each fiber optic strand, said filter pane having a plurality of portions each formed from a light permeable material having a distinct color and wherein strands aligned with said each portion of said filter pane emit a light having a color which is generally identical to said distinct color of said each portion.

4. The device, according to claim 3, wherein said light emitting assembly includes a housing and wherein said power source and said illumination source are mounted within said housing.

5. The device, according to claim 3, wherein said power source is at least one battery.

6. The device, according to claim 3, wherein said power source includes a solar cell capable of converting solar energy into electric energy.

7. The device, according to claim 6, wherein an outer surface of said solar cell is mounted flush with an exterior surface of said body.

8. The device, according to claim 6, wherein said solar cell is removably attached to a predetermined portion of said body.

9. The device, according to claim 6, wherein said device further includes a cover and means for attaching said cover over said solar cell in a water impermeable manner.

10. The device, according to claim 3, wherein said device includes a switch manually operable by a user to selectively operate said illumination source.

11. The device, according to claim 3, wherein said body includes a pocket disposed within a hollow interior thereof and wherein said illumination source and said power source are mounted within said pocket.

12. The device, according to claim 11, wherein said pocket is formed in an air impermeable manner so as to retain said body in an inflated condition.

13. The device, according to claim 3, wherein said fiber optic strands have different lengths.

14. The device, according to claim 3, wherein said device includes a valve operatively mounted within a wall portion of said body for enabling selective inflation and deflation thereof.

* * * * *